US007301501B2

(12) United States Patent
De Vos et al.

(10) Patent No.: US 7,301,501 B2
(45) Date of Patent: Nov. 27, 2007

(54) TELECOMMUNICATIONS CARD FOR MOBILE TELEPHONE NETWORK AND WIRELESS LOCAL AREA NETWORK

(75) Inventors: Chris De Vos, Wemmel (BE); Jan Wijnen, Hasselt (BE); Thomas Stevens, Schaarbeek (BE)

(73) Assignee: Option, Leuven (BE)

( * ) Notice: Subject to any disclaimer, the term of this patent is extended or adjusted under 35 U.S.C. 154(b) by 244 days.

(21) Appl. No.: 10/961,400

(22) Filed: Oct. 12, 2004

(65) Prior Publication Data

US 2005/0079892 A1 Apr. 14, 2005

(30) Foreign Application Priority Data

Oct. 10, 2003 (EP) ..... 03447247

(51) Int. Cl.
*H01Q 1/24* (2006.01)

(52) U.S. Cl. ..... 343/702; 343/895

(58) Field of Classification Search ..... 343/700 MS, 343/702, 895; 455/90.3, 97
See application file for complete search history.

(56) References Cited

U.S. PATENT DOCUMENTS 5,943,018 A * 8/1999 Miller ..... 343/702
6,505,054 B1 1/2003 Douglas et al.
6,518,927 B2 * 2/2003 Schremmer et al. ..... 343/702
6,758,689 B1 * 7/2004 Bair et al. ..... 439/136
6,762,725 B2 * 7/2004 Beard et al. ..... 343/702
2001/0043160 A1 * 11/2001 Hirai et al. ..... 343/702
2002/0022460 A1 2/2002 Lintern et al.

FOREIGN PATENT DOCUMENTS

EP 1 189 304 A2 3/2002
WO WO 02/078123 A1 10/2002

* cited by examiner

*Primary Examiner*—Tan Ho
(74) *Attorney, Agent, or Firm*—Browdy and Neimark, PLLC

(57) ABSTRACT

A telecommunications card for wireless telecommunication between a host device and one or more wireless networks The card comprises electronics for converting data into telecommunication signals and vice versa and a single antenna structure (2) comprising an antenna in the form of a flat radiation pattern (50) for transmitting and receiving said telecommunication signals. The radiation pattern (50) comprises a first portion (51) with a predetermined shape enabling transmission and receipt of telecommunication signals via a mobile telephone network and a second portion (52) with a predetermined shape enabling transmission and receipt of telecommunication signals via a wireless local area network.

39 Claims, 8 Drawing Sheets

TELECOMMUNICATIONS CARD FOR MOBILE TELEPHONE NETWORK AND WIRELESS LOCAL AREA NETWORK

The present invention relates to a telecommunications card according to the preamble of the first claim.

The use of telecommunications cards for providing wireless communication between a host device and a telecommunication network is well known in the art. Such a telecommunications card is a separate device which is provided to be inserted in a slot provided in a host device, such as for example a laptop personal computer or any other device. In order to obtain an electric contact between the components of the telecommunications card and those of the host device, the telecommunications card is provided with an interface, such as a 68-pin connector or any other, which is connectable to a socket or adapter in the slot of the host device.

The telecommunications card according to the invention aims to provide a single card, which can be used for both communication via a mobile telephone network (e.g. GSM/GPRS and PCS/DCS) and communication via a wireless local area network (WLAN). Such a telecommunications card is for example known from KR-A-2003043434, but this document fails to describe an embodiment of an antenna structure for such a card.

It is an aim of this invention to provide a telecommunications card with a single antenna structure enabling wireless communication via a mobile telephone network as well as a wireless local area network.

This aim is achieved according to the invention in that the antenna structure of the telecommunications card comprises an antenna in the form of a flat radiation pattern, comprising a first portion with a predetermined shape enabling transmission and receipt of telecommunication signals via a mobile telephone network and a second portion with a predetermined shape enabling transmission and receipt of telecommunication signals via a wireless local area network.

By the construction of the antenna for both intended wireless networks as a single radiation pattern, it is avoided that two separate antennas need to be coupled to the card to enable communication over each network. Furthermore, the single radiation pattern having a dedicated portion for each network can be implemented on a single PCB, so that the overall size of the antenna remains limited. In fact, this makes it possible to reduce the size of the antenna to such an extent that it can be fitted substantially within the dimensions of the PCMCIA standard (type II), although this is not essential. As a result, the telecommunications card can remain small in size and avoid an excessive amount of components.

The portion of the radiation pattern which is designed for communication via the mobile telephone network preferably comprises a first leg for telecommunication in a first frequency band, for example around 900 MHz and a second leg for telecommunication in a second frequency band, for example around 1800-1900 MHz. In this way, this portion of the radiation pattern can support a worldwide coverage of all present-day mobile telephone frequencies.

The first leg is preferably a thin meander with an electric length of about $\lambda/4$ or an odd multiple, $\lambda$ being the average wavelength of the first frequency band. The second leg is preferably a wide stub with an electric length of about $\lambda/4$ or an odd multiple, $\lambda$ being the average wavelength of the second frequency band. The first and second legs may be connected to a common contact, via which the telecommunication signals are conducted to and from the electronics within the card. The number and shape of the legs may vary to provide communication at different or further frequencies than mentioned herein. The leg, which is actually used during communication, is determined by the frequency of the network operator and is selected on a protocol basis.

The second portion of the radiation pattern, which is designed for communication via the wireless local area network, is preferably optimised for telecommunication in a frequency band comprising 2.4 GHz, but any other frequency band of wireless local area networks is also possible, such as for example 5 GHz. This second portion preferably comprises a radiant element which is capacitively coupled to a second contact via which the telecommunications signals are conducted to and from the electronics within the card. This capacitive coupling is applied for pulling the radiation which Is excited by the antenna element towards the outside of the telecommunications card, so that harm to its operation can be avoided.

The radiant element preferably has a meander configuration of electric length $\lambda/2$ of an odd multiple, $\lambda$ being the telecommunication wavelength of the wireless local area network. Preferably, a conductive stub of electric length $\lambda/4$ connects the capacitive coupling area to the second contact.

The PCB material on which the radiation pattern is printed is preferably kapton, but may also be any other PCB material known to the person skilled in the art. In the enclosure of the card, preferably absorption material is inserted for avoiding harm to the operation of the card components by the radiation emitted by the antenna. The absorption material is preferably as such that the insertion losses are very high at the frequencies concerned, and may for example be formed by a thin sheet of silicon rubber blend together with magnetic particles, or any other absorption material known to the person skilled in the art.

As mentioned above, the small size of the antenna of the card of the invention makes it possible to integrate the antenna into the card. As a result, a preferred embodiment of the telecommunications card of the invention comprises a movable antenna structure, in which the antenna is mounted, the antenna structure being substantially fully retractable into a cavity within the card. This embodiment has the advantage that the antenna structure can be stored in the card when not in use and can be extended from the card only when needed for telecommunication.

The antenna structure is furthermore preferably removably mounted in the cavity. The removability of the antenna portion has number of advantages. A first advantage is that the manufacturing of the telecommunications card can be simplified, as the erectable antenna portion can be mounted after the assembly of the telecommunications card itself. A second advantage is that, after manufacturing the telecommunications card, it can be customised by selecting and mounting an antenna portion which is most suited to the needs of the user. The removability of the antenna portion also makes it possible to simply mount a new antenna portion when the original has been damaged.

The electrical connection between the antenna structure and the electronics within the card is preferably such, that the antenna is only in electrical communication with the electronics when the antenna structure is extended from the cavity. In this way, unintended network camping or telecommunication signals can be prevented.

Each portion of the radiation pattern mounted in the antenna structure is preferably connected to its own external contact. This has the advantage that a selection between telecommunication via mobile telephone network or wireless local area network can be made on a hardware basis.

The invention will be further elucidated by means of the following description and the appended figures.

FIGS. 1*a-c* show a first preferred embodiment of the telecommunications card according to the invention, with the antenna structure respectively in a first position inside the card, in a second position extended from the card and in a third position erected for wireless communication.

FIG. 2 shows a second embodiment of the telecommunications card according to the invention located in a slot of a laptop PC, the card comprising a coaxial connector and an audio connector.

FIGS. 3*a-b* show a third embodiment of the telecommunications card according to the invention further comprising a slot for receiving a SIM-card.

Figure 1A:
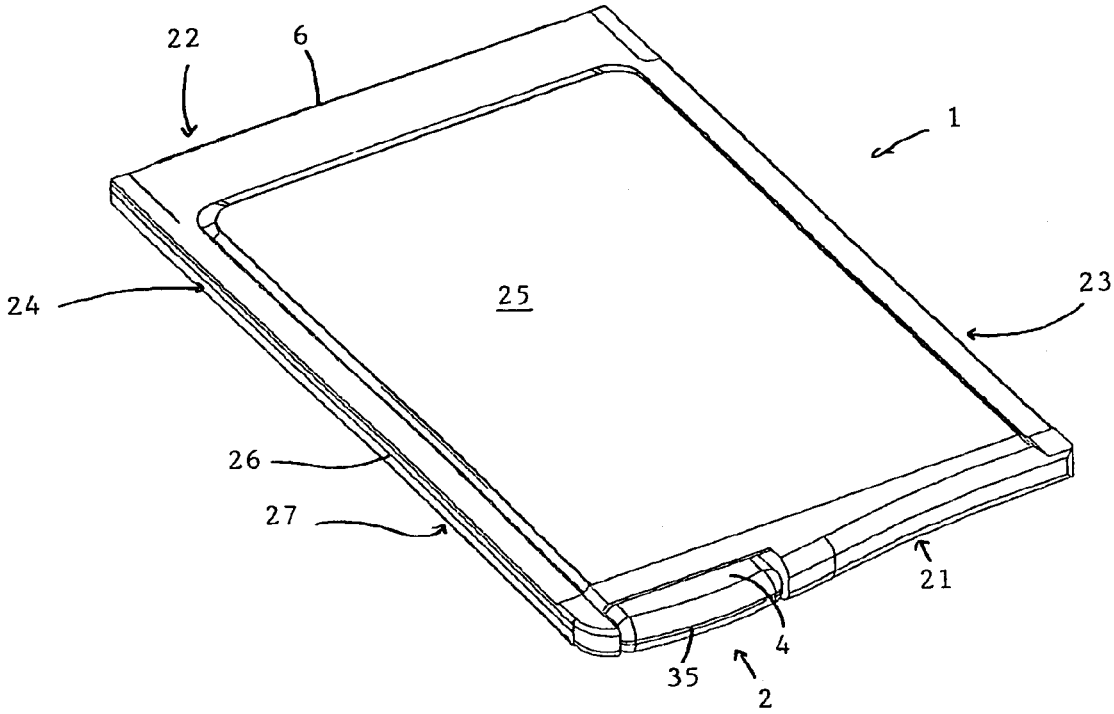

The telecommunications cards shown in the figures are intended to enable wireless communication via a mobile telephone network as well as a wireless local area network (WLAN) by means of a single antenna structure 2. To this end, the antenna structure 2 of the telecommunications card 1 of FIG. 10-13 is provided with two external contacts 60, 61 via which two antenna elements 51, 52 in the structure 2 can be operated. These contacts 60, 61 are each provided with a pre-loaded spring 62, which enables release of the antenna structure 2 from the card cavity 3.

Figure 9:
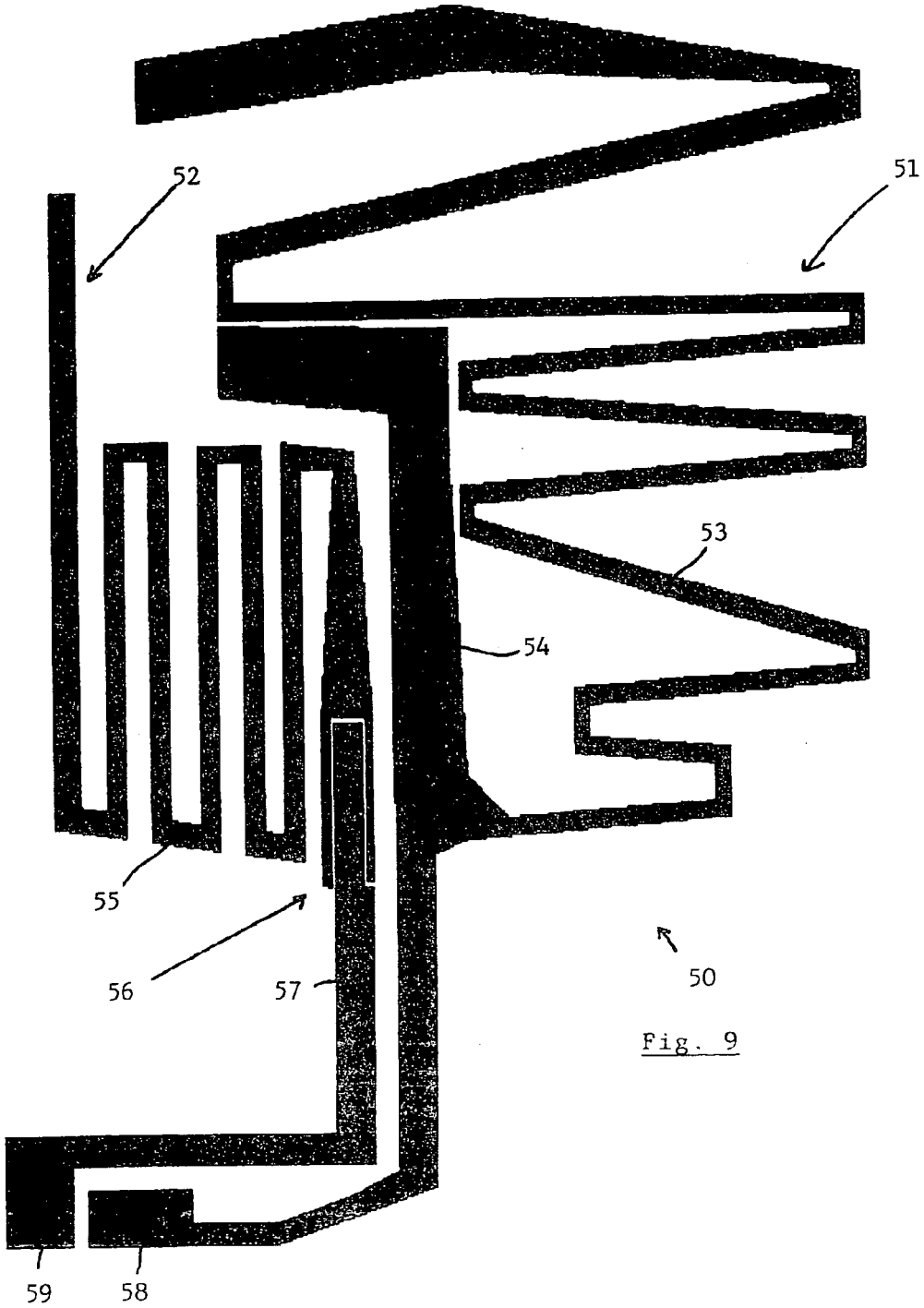
FIG. 9 shows a preferred embodiment of the radiation pattern for the antenna elements of the telecommunications card according to the invention.
Figure 13:
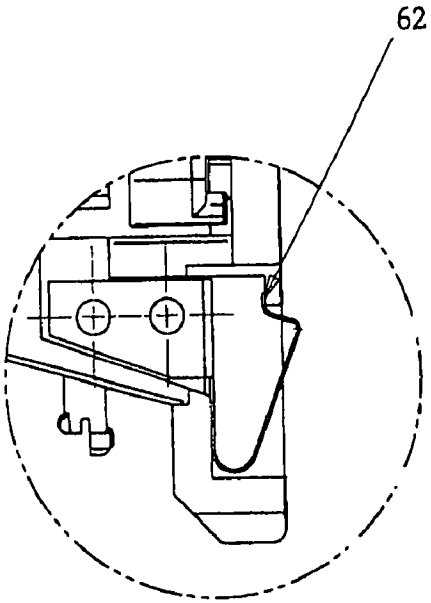
FIGS. 10-13 show details of a preferred embodiment of the antenna structure with double contacts for selectively connecting the different antenna elements.
Figure 12:
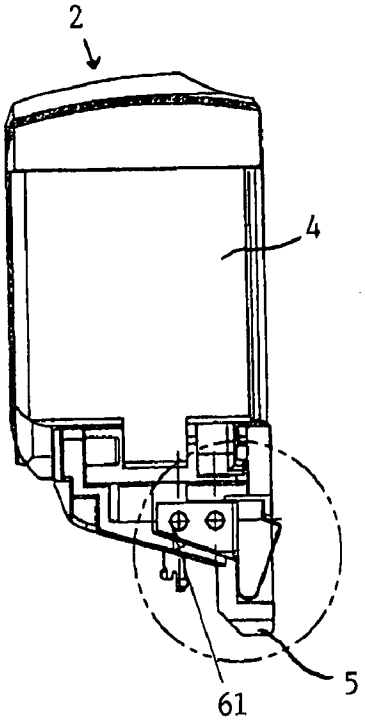
Figure 11:
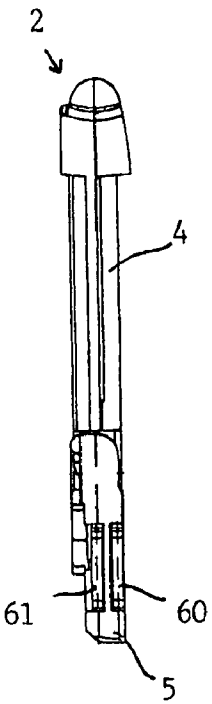
Figure 10:
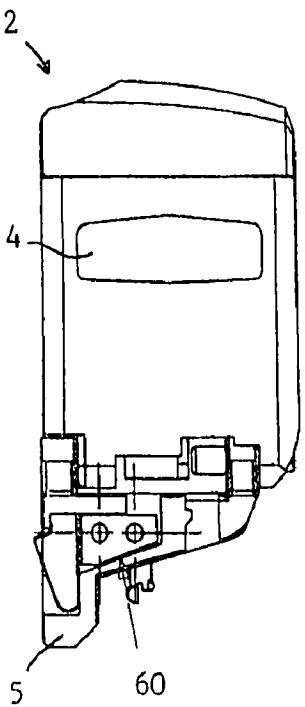

The two antenna elements 51, 52 within the antenna structure 50 are constructed as portions of one and the same radiation pattern 50, as shown in FIG. 9. A first portion 51 of this radiation pattern 50 forms the antenna element for mobile telephone networks, which preferably comprises two legs 53, 54, one 53 for communication around 900 MHz and one 54 for communication around 1800-1900 MHz, which are the two common frequency bands which are today used for mobile telephony. The number and shape of the legs may vary to provide communication at different frequencies and within wider or narrower frequency bands. The leg 53, 54, which is actually used during communication, is determined by the frequency of the network operator and is selected on a protocol basis. A second portion 52 of the radiation pattern of FIG. 9 forms the antenna element for WLAN communication, i.e. communication at a high frequency such as 2.4 GHz or other WLAN frequencies. This WLAN antenna element 52 is capacitively coupled to its contact 59. This capacitive coupling 56 is applied for pulling the radiation which is excited by the antenna element 52 towards the outside of the telecommunications card 1, so that harm to its operation can be avoided.

In order to keep the size of the antenna structure 2 limited, a lot of effort has been put in the design of the antenna elements 51, 52 of the radiation pattern 50 and the materials in which they are constructed.

The PCB material on which the radiation pattern 50 is printed is preferably kapton, but may also be any other PCB material known to the person skilled in the art. Isolation and mechanical reinforcement material do not cause any significant deviation on performance. The thickness of the legs and printed wires of the radiation pattern 50 is between 20 and 50 micron. Their material is preferably a printing copper or other conventional materials.

The electromagnetic concept of the different antenna elements 51, 52 is as follows. The phone network element 51 comprises a leg 53 of electric length $\lambda/4$ for the 900 MHz GSM band ($\lambda$ is the electric length at 900 MHz with $\lambda f = c2$ where c is the light speed on kapton) shunted by a wider stub 54 of $\lambda/4$ for the 1800 (DCS) and 1900 MHz (PCS) band. The WLAN element 52 comprises a special pattern: there is a $\lambda/4$ connection stub 57 subsequently followed by a radiant element 55 of $\lambda/2$. The section between the $\lambda/4$ and the $\lambda/2$ part is a capacitive slot, which forms the capacitive coupling 56. The capacitive coupling 56 is used for two reasons: (1) although the $\lambda/4$ part is yet a radiant element but with very bad performance ($\lambda/2$ is much better) it exists as a physically electric connection, so that the fact that most power has to be radiated in the $\lambda/2$ element has to be taken into account; (2) the constituent parts of $3\lambda/4$ are a $\lambda/4$ leg and the $\lambda/2$ part where the latter is quite close to the $\lambda/2$ electric length of the PCS/DCS (1800/1900 MHz) band, so that most energy of the radiating power of the DCS/PCS band would be absorbed by the WLAN 2.4 GHz radiating element without the capacitive slot.

The performances of the different antenna elements 51, 52 is optimized by shunting off or closing of the outputs (or inputs, since antenna elements are reciprocal which means that the aim is to have the same electromagnetic behavior and performance whether applied as transmitter or receiver) with an impedance of 50 ohm resistive. Optimal has to be understood as having the best 'insertion loss' in dB as possible at those frequencies defined above.

Figure 2:
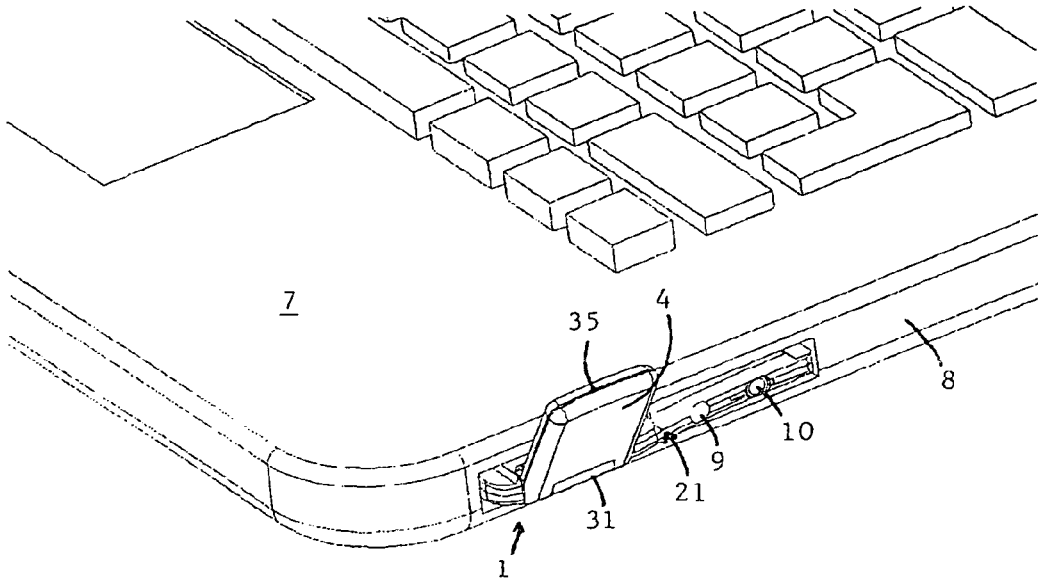

Since the antenna beam produces a mirror electromagnetic field and the telecommunications card 1 is in use fully engaged in a host device 7 such as a laptop computer, such as shown in FIG. 2, there is a risk of disturbing the CPU clock of the host device 7. This phenomenon is even worse when the clock frequency of the CPU is in close proximity to either the GSM/GPRS or WLAN operating frequencies. Therefore it is preferred to incorporate absorption material (not shown) in the enclosure of the telecommunications card 1 of the invention. The selection of the absorption material is as such that the insertion losses are very high at the frequencies concerned.

The absorption material is a thin sheet of silicon rubber blend together with magnetic particles. By its curving ability, this material blends very well with the PCB and components unevenness. The material has a very high attenuation at UHF bands. It can be applied as well to reduce stray surface currents. The attenuation is approximately 15 dB/cm at 1 GHz and 24 dB/cm at 3 GHz. The breakdown voltage is preferably better than 10 kV/mm. Other absorption materials known the person skilled in the art may however also be used.

Figure 1B:
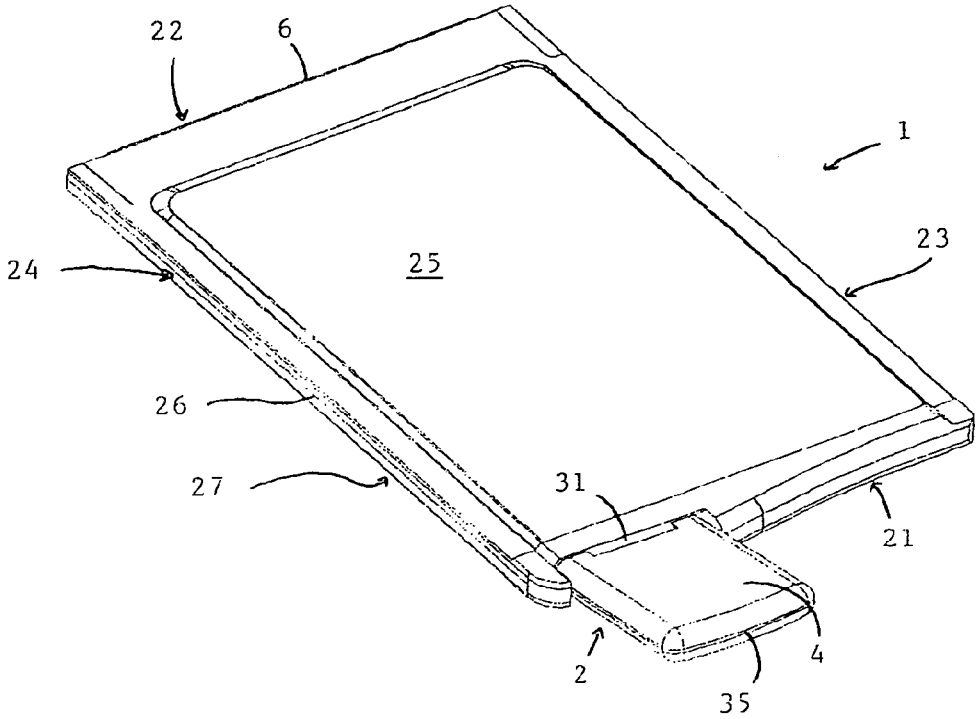
Figure 1C:
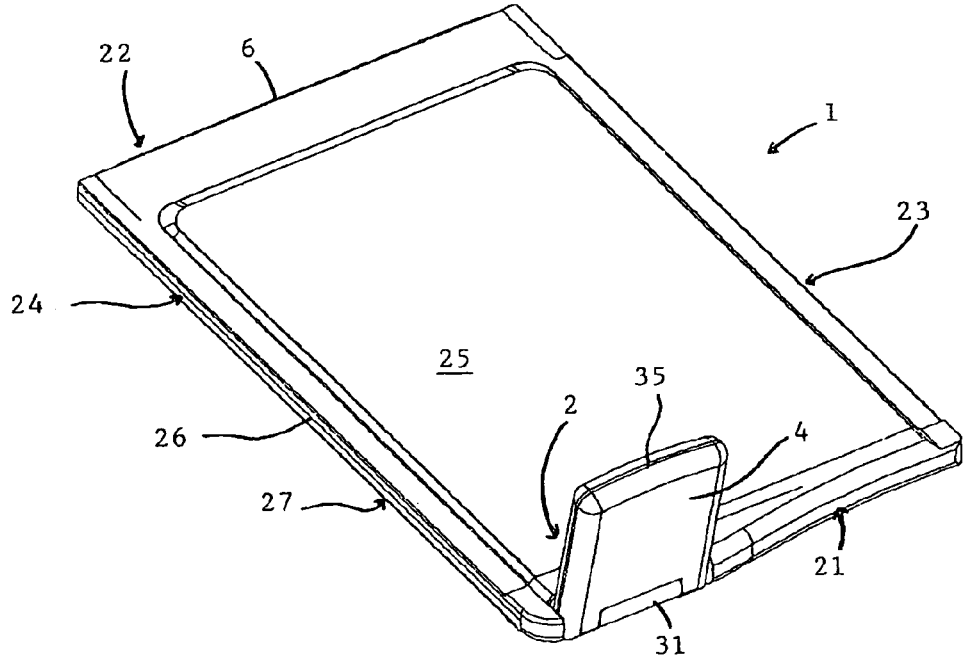

The telecommunications card 1 shown in FIGS. 1*a-c* comprises an antenna structure 2 which is movably mounted in a cavity 3. The antenna structure 2 can be moved between a first position in which it is substantially located within the cavity (FIG. 1*a*), and a second position in which the antenna structure is extended from the cavity (FIG. 1*b*). Moving means are provided in the telecommunications card 1 for moving the antenna structure 2 from the first to the second position. The antenna structure 2 comprises a slide portion 5 and an antenna portion 4, which are movably connected to each other. The antenna structure further comprises erecting means for erecting the antenna portion 4 to a third position suitable for wireless communication (FIG. 1*c*) via each of the telecommunication networks as described above. In the third position, the antenna portion is preferably erected such that the angle between the plane formed by the antenna portion and the plane of the telecommunications card is larger than 30° but smaller than 90°, the optimum angle being about 60°.

The moving means for moving the antenna structure 2 from the first to the second position preferably comprise a compression spring 32, but may also comprise any other moving means known to the person skilled in the art, such as for example a micromotor or any other.

The erecting means of the antenna structure 2 preferably comprise a torsion spring 39, but may also comprise a rotating cam action or any other kind of erecting means known to the person skilled in the art.

FIG. 2 shows a telecommunications card 1 according to the invention located in a slot of a laptop PC 7 with the antenna portion 4 in the third position suitable for wireless communication. The slot is provided in a side 8 of the laptop PC 7. As the angle between the plane formed by the antenna portion 4 and the plane of the telecommunications card 1 is between 30° and 90°, preferably 60°, a free space is present between the antenna portion 4 and the side 8 of the laptop PC 7. This free space can prevent the interference that occurs between electric components in the antenna portion 4 and electric components in the laptop PC 7. Furthermore, the free space can provide room for the hands of the user of the laptop PC during typing. Erecting the antenna portion 4 to an angle larger than 30° but smaller than 90°, the optimum angle being about 60°, provides a nearly optimal position for ensuring a good wireless communication in all conditions.

The telecommunications card 1 preferably has a substantially rectangular shape with a front side 21, a back side 22 and two lateral sides 23, 24. The telecommunications card is preferably composed as a laminate of a top layer 25, an intermediate layer 26 and a bottom layer 27. The top and bottom layers are preferably made from sheet metal, but may also be made from any other material deemed suitable by the person skilled in the art. The intermediate layer preferably comprises a printed circuit board 28 for mounting the electronic and other components of the card 1. The card 1 is further provided with a supporting frame 29 for supporting the printed circuit board 28, the antenna structure 2 and any other components of the card 1. This supporting frame 29 may be a separately moulded part of the intermediate layer 26, or may be constructed in two parts which are moulded onto the sheet metal of the top and bottom layers 25, 27.

The antenna structure 2 is preferably located on the front side 21 of the card 1. In this way it is accessible when the telecommunications card 1 is located in a slot of a host device 7. For connecting the telecommunications card 1 to the host device 7, the telecommunications card 1 preferably comprises an interface 6, which is preferably located on the back side 22 of the card 1. This interface can be a standard 68-pin connector or any other interface known to the person skilled in the art.

In the embodiment shown in FIG. 2, the telecommunications card 1 comprises a coaxial connector 9 for connecting a coaxial cable (not shown) to the telecommunications card. This coaxial connector is preferably located on the front side 21, so that it is accessible when the telecommunications card 1 is located in the slot of the host device 7. By providing the coaxial connector 9, the telecommunications card 1 can be connected via a coaxial cable to any equipment known to the person skilled in the art, which equipment is provided to communicate with the telecommunications card 1. This equipment can for example be a further antenna, which can be used in case the antenna provided in the telecommunications card shows a malfunction or when a higher-gain antenna is needed than the antenna 2 provided in the telecommunications card. The coaxial connector 9 also provides an access for any type of measurement apparatus, by means of which any characteristic of any component of the telecommunications card can be measured. The measurement apparatus can for example serve to locate any malfunction of a component in the card, or to regulate any component in the card, or to any other purpose.

The telecommunications card 1 of FIG. 2 further comprises an audio connector 10 for connecting a headset (not shown) comprising a microphone and a speaker to the telecommunications card 1, or for connecting any other audio device to the telecommunications card. This audio connector 10 is preferably located on the front side 21, so that it is accessible when the telecommunications card 1 is located in the slot of the host device 7. The audio connector 10 is preferably a stereo jack, but may also be any other audio connector known to the person skilled in the art.

Figure 3A:
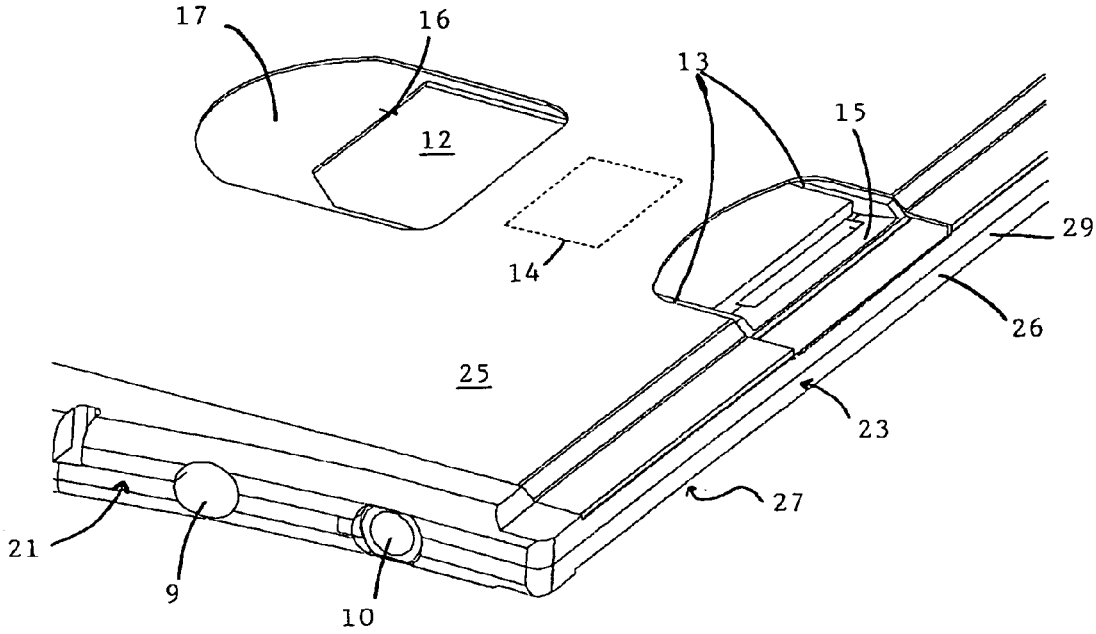

In the embodiment shown in FIGS. 3*a* and *b*, the telecommunications card 1 is provided with a slot 11 for inserting a SIM-card 12. The slot is preferably provided in the supporting frame 29 with direct access through the top layer 25. The SIM-card 12 is preferably insertable into the slot 11 through an insertion opening in one of the lateral sides 23, 24 of the telecommunications card 1. In this way, the SIM-card can only be inserted into or removed from the telecommunications card when the telecommunications card is outside the slot of the host device 7. Furthermore, the SIM-card is protected when the telecommunications card is located in the host device 7. In FIGS. 3*a* and *b*, the insertion opening is located on the right lateral side 23, which leaves space for incorporating the antenna structure 2 near the left lateral side 24. The insertion opening may however also be located on the left lateral side 24, the front side 21 or the back side 22. The slot 11 for inserting the SIM-card 12 may also be accessible through an insertion opening in the top layer 25 or the bottom layer 27.

To facilitate insertion and removal of the SIM-card 12, the top layer 25 above the slot 11 can be coated with a smooth material. The slot 11 preferably has edge guides 13 for guiding opposite edges of the SIM-card during insertion or removal. These edge guides 13 are preferably provided on the supporting frame 29. A SIM-card connector 14 is preferably mounted on the printed circuit board 28 in such a way that it forms part of the bottom side of the slot 11, the connector being provided to contact the contact pads on the SIM-card 12 when the SIM-card is located in the slot 11. As the edge guides 13 are provided on the supporting frame 29 and the SIM-card connector 14 forms part of the bottom side of the slot 11, the use of a separate SIM-card holder comprising edge guides 13 and connector 14 can be avoided. In this way, a certain amount of internal space of the telecommunications card 1 can be saved, as no holding means for holding the separate SIM-card holder in position have to be provided in the card. This saving of space provides part of the space necessary for integrating the antenna structure 2 in the telecommunications card 1.

To ensure that the SIM-card 12 is correctly slid over the SIM-card connector 14, a ramp 15 can be provided on the supporting frame 29 at the entrance of the slot 11. Furthermore, an end stop 16 can be provided on the supporting frame 29 for fixing the SIM-card in its correct position.

The top layer 21 is preferably provided with a second opening 17 on an end of the slot 11 opposite the insertion opening. This second opening 17 allows a user to easily remove the SIM-card 12 from the slot 11 by pushing the SIM-card towards the insertion opening by means of a finger or a tool. However, this second opening is designed such that the user cannot touch the contact pads of the SIM-card connector 14, so that damage of the SIM-card connector can be avoided.

Figure 4:
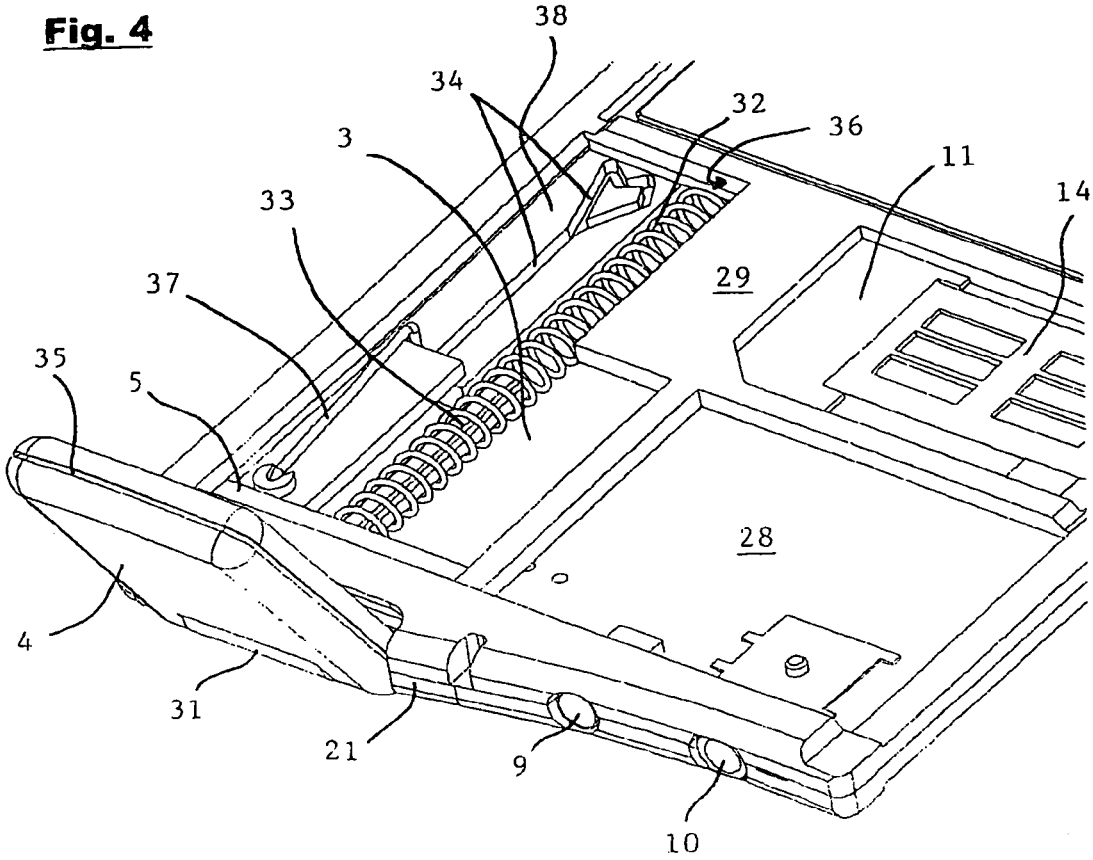
FIG. 4 shows a detail of the interior of the third embodiment of the telecommunications card according to the invention.
Figure 5:
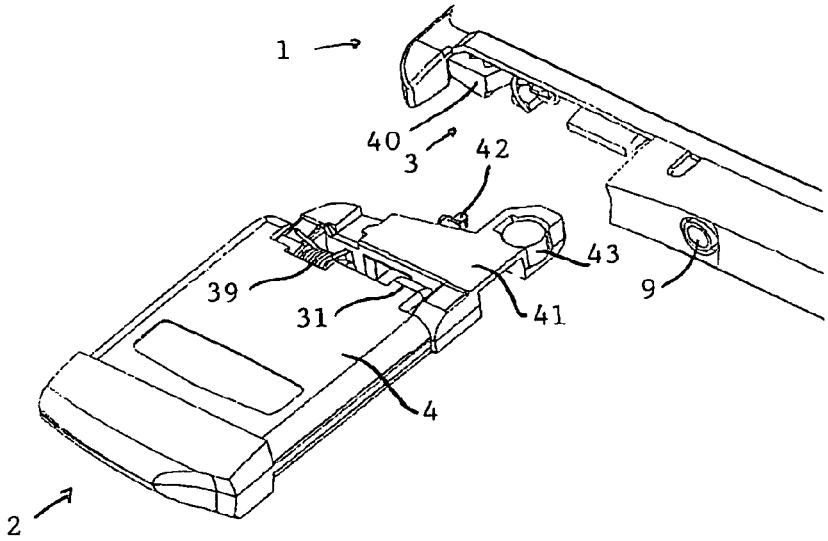
FIGS. 5-8 show details of a fourth and more preferred embodiment of the telecommunications card according to the invention, the card having a removable antenna structure.
Figure 6:
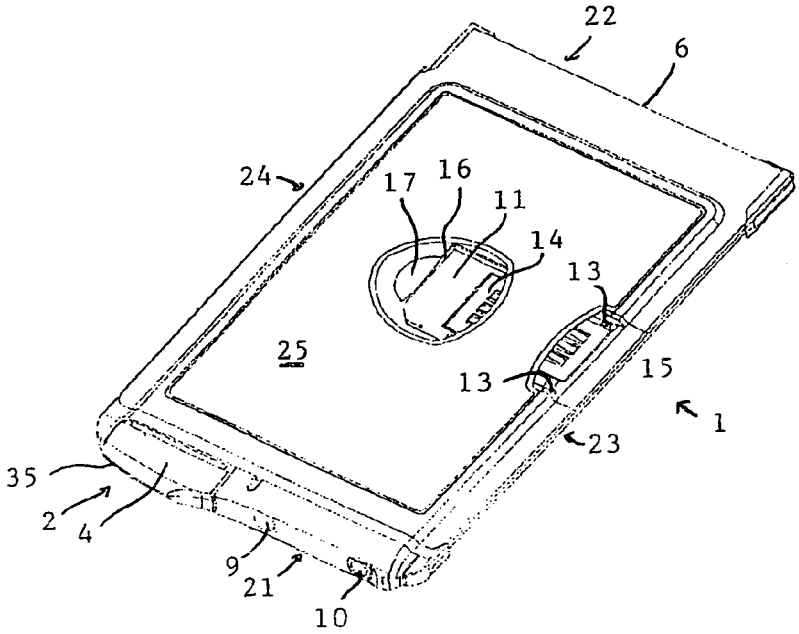
Figure 7:
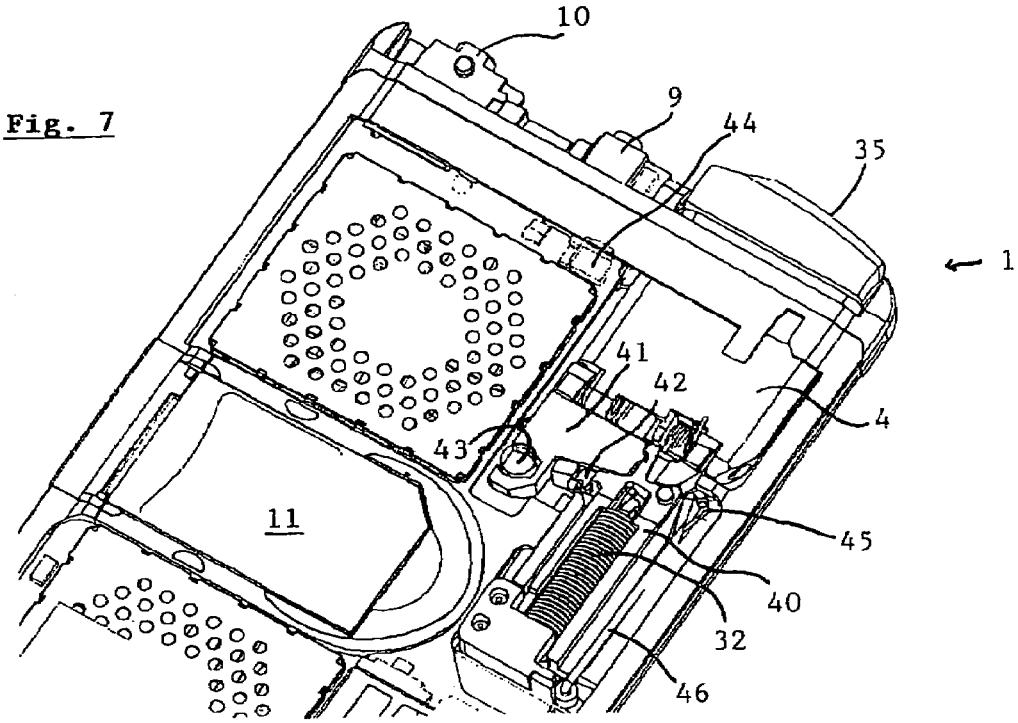
Figure 8:
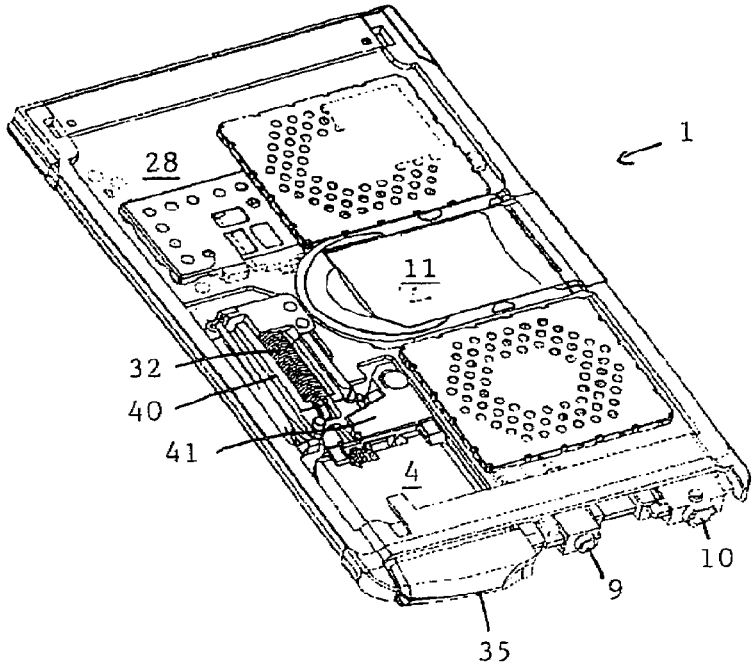

Referring now to FIG. 4, the mounting of the antenna structure 2 in the telecommunications card 1 will be described in more detail. The antenna structure 2 is incorporated in a cavity 3, which is provided in the intermediate layer 26. In the first position, the antenna structure is located within the cavity 3. In the second and third positions, the antenna structure is extended from the cavity 3. The moving means 32, 33 for moving the antenna structure from the first to the second position preferably comprise a spring 32 which is mounted on a bar 33 extending in moving direction of the slide portion 5 of the antenna structure. When the antenna structure 2 is in the first position, the spring is compressed between the slide portion 5 and a back side 36 of the cavity 3. The moving means may however also be constructed in any other way known to the person skilled in the art.

The slide portion 5 and the antenna portion 4 of the antenna structure 2 are movably connected to each other by means of a hinge 31. The erecting means for erecting the antenna portion from the second position to the third position suitable for wireless communication can for example be a torsion spring inside the hinge 31, or any other erecting means known to the person skilled in the art.

The telecommunications card shown in FIG. 4 is preferably further provided with locking means 34, 37 for locking the antenna structure 2 in the first position. This has the advantage that the antenna structure can be locked in the first position while it is not in use. The locking means 34, 37 are preferably constructed such that a user can unlock the antenna structure by pressing an edge 35 of the antenna structure which is accessible from outside the telecommunications card, upon which the antenna structure is moved to the second position, after which the antenna portion is erected to the third position.

In the embodiment shown in FIG. 4, the locking means 34, 37 comprise a connector bar 37 which is movable in a retention track 34. The retention track 34 is provided in a bottom side 38 of the cavity 3 and extends in a plane substantially parallel to the plane of the telecommunications card 1. The connector bar 37 is a hooked element which has one end movable in the retention track 34 and the other end rotatably fixed to the slide portion 5 in such a way that the connector bar 37 can rotate in a direction perpendicular to the moving direction of the slide portion 5. The retention track 34 comprises a longitudinal groove which extends in the moving direction of the slide portion 5 and is divided into a substantially heart-shaped groove near the back side 36 of the cavity. The geometry of the substantially heart-shaped groove is such that, during movement of the antenna structure 2, the end of the connector bar 37 running in the retention track 34 is forced to follow the substantially heart-shaped groove in counterclockwise direction. This is achieved by making the sides of the heart-shaped groove such that each time the end of the connector bar 37 running in the track 34 hits a side wall of the heart-shaped groove, this side wall guides this end in counterclockwise direction. When the antenna structure 2 is in the first position within the cavity 3, this end of the connector bar 37 rests substantially halfway in the heart-shaped groove. In other words, this end of the connector bar 37 runs along the right hand part of the heart-shaped groove when the antenna structure is moved from the second position extended from the cavity to the first position within the cavity, and along the left hand part of the heart-shaped groove when the antenna structure is moved from the first position to the second position. Providing the above described connector bar 37 and retention track 34 has the advantage that the user can unlock the antenna structure 2 from the first position by simply pressing the edge 35 of the antenna portion, and lock the antenna structure 2 in the first position by simply pushing the antenna structure as far as possible into the cavity 3.

Of course, the telecommunications card 1 can also be provided with any other kind of locking means known to the person skilled in the art for locking the antenna structure 2 in the first position within the cavity.

The telecommunications card of FIG. 4 is preferably further provided with switching means (not shown) for alternatively selecting between the antenna 4 and the coaxial connector 9. The switching means may be an electronic switch, for example a transistor switch, or a mechanical switch, or any other switch known to the person skilled in the art. Providing such switching means has the advantage that a selection can be made between wireless communication using the antenna 4 integrated in the card and communication using the coaxial connector 9.

The switching means of the telecommunications card of FIG. 4 is preferably operated by detecting means for detecting whether the antenna portion 2 is in the first position or the third position. These detecting means can for example comprise first and second contact pads 36 which are provided to contact each other when the antenna structure 2 is in the third position and are spaced apart when the antenna structure is in the first position, a current source (not shown) for providing an electric current to the contact pads 36 and a feedback conductor (not shown) connecting the contact pads to the switching means. When the antenna structure is in the third position, the contact pads 36 conduct the electric current from the current source to the switching means. Otherwise, when the antenna structure is in the first position, the contact pads 36 form an obstruction for the electric current. The detecting means can also be any other detecting means known to the person skilled in the art. Providing the detecting means has the advantage that the switching means know which position the antenna structure is in and accordingly select the antenna when it is in the third position and the coaxial connector when the antenna structure is in the first position.

The telecommunications card 1 is operated as follows. When not in use, the antenna structure 2 is in the first position within the cavity 3. If a SIM-card is not yet located in the slot 11 of the telecommunications card 1, the user inserts a SIM-card 12 into the slot 11 in such a way that the contact pads of the SIM-card 12 are in contact with the contact pads of the SIM-card connector 14. Then the user slides the telecommunications card in the slot of the host device 7 in such a way that the interface 6 connects the card 1 to the host device 7. For performing wireless communication with the integrated antenna 2, the user simply presses the accessible edge 35 of the antenna structure 2, so that the locking means 34 are unlocked. As a result, the moving means 32, 33 move the antenna structure 2 from the first to the second position, in which the antenna structure 2 is extended from the cavity. Then the erecting means erect the antenna portion 4 to the third position, in which the plane of the antenna portion 4 forms an angle larger than 30° but smaller than 90°, the optimum angle being about 60°. The detecting means detect that the antenna structure 2 is in the third position, which information is provided to the switching means Accordingly, the switching means select the antenna 4 for performing wireless communication. Now the card is ready for communicating wirelessly with a telecommunications network, using the integrated antenna 4.

When the user wants to stop the wireless communication, or when the user wants to use the coaxial connector 9 for performing wireless communication, the user simply pushes down the antenna portion 2 until it is in the second position, after which the user pushes the antenna structure 2 into the cavity 3. The antenna structure 2 is locked within the cavity by the locking means 34. The detecting means now detect that the antenna structure 2 is in the first position, which information is provided to the switching means. The switching means accordingly select the coaxial connector 9 for any further wireless communication.

If the user wishes to communicate with an other person in the manner of a conventional wireless telephone, the user simply connects a headset comprising a microphone and a headphone to the audio connector 10. When the host device 7 is a laptop PC, the keyboard of the laptop PC can be used for dialling the telephone number the user wishes to talk to.

Referring to FIGS. 5-8, a more preferred embodiment of the telecommunications card 1 according to the invention will be described. In this embodiment, the antenna portion 4 is removable from the slide portion 5. To this end, the slide portion 5 comprises a chassis 40, which is movably mounted in the cavity 3 of the telecommunications card 1, and an insert 41, on which the antenna portion 2 is movably mounted. The insert 41 is removably mounted on the chassis 40. In this way, the antenna portion 2 can for example be removed from the telecommunications card 1 and replaced when damaged. Furthermore, the removability of the antenna portion 2 can simplify the manufacturing of the telecommunications card 1, as the antenna portion 2 can be inserted into the cavity 3 in a final step. This also enables the customisation of the telecommunications card by providing a set of antennas 2 with different properties which can all be removably mounted in the telecommunications card 1.

The removable mounting of the insert 41 on the chassis is preferably achieved by means of a popper clip 42 on the insert 41, which is provided to release on exertion of a given amount of pull force onto the antenna portion 2. In the embodiment of FIGS. 10-13, the releasable mounting is achieved by the pre-loaded spring 62 which is provided on each external contact 60, 61 of the antenna structure 2. The removable mounting may however also be achieved by any other means known to the person skilled in the art.

Figure 3B:
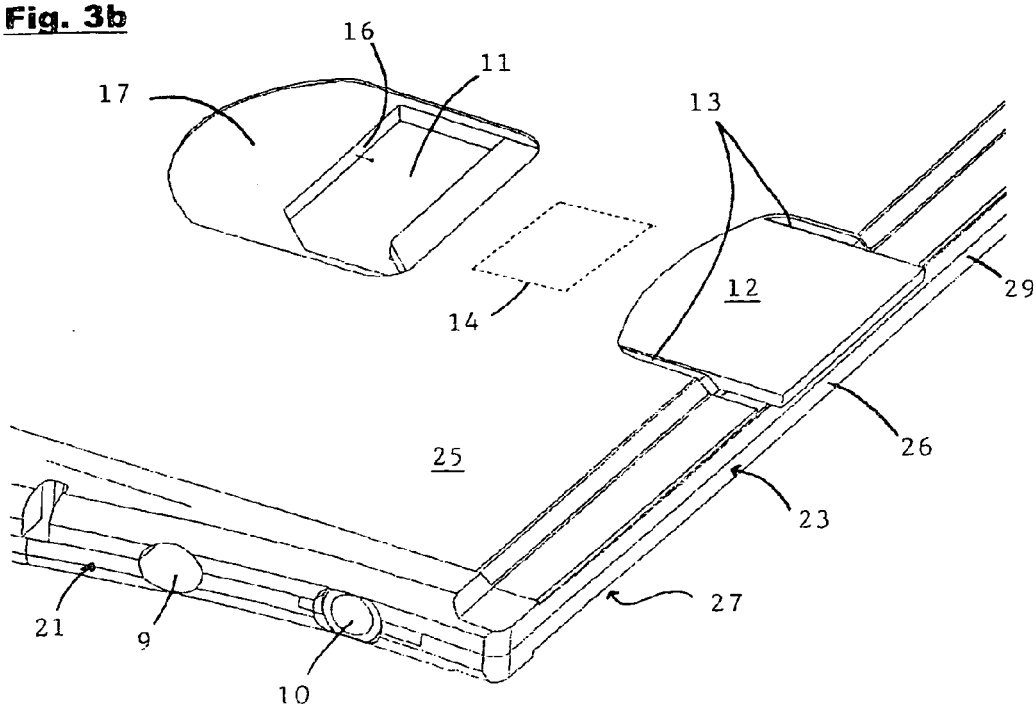

The embodiment of the telecommunications card 1 shown in FIGS. 5-8 differs from the embodiment shown in FIGS. 3-4 in that the switching means (not shown) for selecting between the internal antenna and an external antenna is provided to select the external antenna upon insertion of its coaxial cable into the coaxial connector 9. To this end, the switching means is preferably incorporated in the coaxial connector 9. As a result, no switching means have to be provided in the interior of the telecommunications card, which has the advantages of saving space and limiting the number of assembly steps for manufacturing the card. This also has the advantage that a coaxial connector 9 with incorporated cable detection, which is known in the art, can be used as switching means for selecting between the internal and external antennas.

In this embodiment, the switching means is not operated by detecting means for detecting the position of the antenna portion 2, as the switching means in itself select the coaxial connector 9 upon insertion of a coaxial cable, whether or not the antenna portion 4 is in the third position for wireless communication. The detecting means are however preferably not left out in the telecommunications card of FIGS. 5-8. In this embodiment, they are preferably provided on the telecommunications card for enabling wireless communication via the internal antenna 2 when in the third position and disabling the internal antenna 2 otherwise. It is however clear that the switching means disable the internal antenna 2 even when it is in the third position upon insertion of a coaxial cable into the connector 9.

The detecting means of the embodiment shown in FIGS. 5-8 comprise a magnet 43 on the insert 41 of the slide portion which is provided to cooperate with a hall effect sensor 44 in the interior of the card 1. The magnet 43 and the sensor 44 are mounted such that the magnet 43 is located next to the sensor 44 when the antenna portion 4 is in the third position.

The locking means 45, 46 for locking the antenna structure 2 in the first position within the cavity 3 are switched in the embodiment shown in FIGS. 5-8 with respect to the embodiment of FIG. 4. The hooked member 46 is here mounted on the bottom side of the cavity 3 and the heart-shaped groove is provided in the chassis 40 of the slide portion 5. As the parts are merely switched, it is clear that the operation of the locking means remains substantially the same as described above with reference to FIG. 4.

| Reference list | |
|---|---|
| 1 | Telecommunications card |
| 2 | Antenna structure |
| 3 | Cavity |
| 4 | Antenna portion |
| 5 | Slide portion |
| 6 | Interface |
| 7 | Host device |
| 8 | Side |
| 9 | Coaxial connector |
| 10 | Audio connector |
| 11 | Slot |
| 12 | SIM-card |
| 13 | Edge guides |
| 14 | SIM-card connector |
| 15 | Ramp |
| 16 | End stop |
| 17 | Second opening |
| 21 | Front side |
| 22 | Back side |
| 23 | Right lateral side |
| 24 | Left lateral side |
| 25 | Top layer |
| 26 | Intermediate layer |
| 27 | Bottom layer |
| 28 | Printed circuit board |
| 29 | Supporting frame |
| 31 | Hinge |
| 32 | Spring |
| 33 | Bar |
| 34 | Locking means |
| 35 | Edge |
| 36 | Back side |
| 37 | Connector bar |
| 38 | Bottom side |
| 39 | Torsion spring |
| 40 | Chassis |
| 41 | Insert |
| 42 | Popper clip |
| 43 | Magnet |
| 44 | Hall effect sensor |
| 45 | Groove |
| 46 | Connector bar |
| 50 | Radiation pattern |
| 51 | First portion (GSM, . . . ) |
| 52 | Second portion (WLAN) |

-continued

| Reference list | |
|---|---|
| 53 | First leg |
| 54 | Second leg |
| 55 | Radiant element |
| 56 | Capacitive coupling area |
| 57 | Conductive stub |
| 58 | First contact |
| 59 | Second contact |
| 60 | External contact |
| 61 | External contact |
| 62 | Pre-loaded spring |

The invention claimed is:

1. A telecommunications card for wireless telecommunication between a host device and one or more wireless networks, the card comprising electronics for converting data into telecommunication signals and vice versa and a single antenna structure (2) comprising an antenna in the form of a flat radiation pattern (50) for transmitting and receiving said telecommunication signals, characterized in that said radiation pattern (50) comprises a first portion (51) with a predetermined shape enabling transmission and receipt of telecommunication signals via a mobile telephone network and a second portion (52) with a predetermined shape enabling transmission and receipt of telecommunication signals via a wireless local area network, and characterised in that the first portion (51) comprises a first (53) leg which is shaped for telecommunication in a first mobile telephony frequency band and a second leg (54) which is shaped for telecommunication in a second mobile telephony frequency band different from the first.

2. A telecommunications card according to claim 1, characterized in that the first mobile telephony frequency band comprises the frequency of 900 MHz and the second mobile telephony frequency band comprises the frequencies of 1800 MHz and 1900 MHz.

3. A telecommunications card according to claim 2, characterized in that the first leg (53) is a thin meander with an electric length of about $\lambda/4$ or an odd multiple for the first frequency band and that the second leg (54) is a wide stub with an electric length of about $\lambda/4$ or an odd multiple for the second frequency band, $\lambda$ being the average wavelength of the respective frequency band, the first and second legs (53, 54) being connected to a common first contact (58) via which the telecommunication signals are conducted to and form said electronics.

4. A telecommunications card according to claim 1, characterized in that the second portion (52) is optimised for telecommunication in a frequency band comprising 2.4 GHz.

5. A telecommunications card according to claim 1, characterized in that the second portion (52) comprises a radiant element (55) which is capacitively coupled (56) to a second contact (59) via which the telecommunication signals are conducted to and from said electronics.

6. A telecommunications card according to claim 5, characterised in that the radiant element (55) has a meander configuration of electric length $\lambda/2$ or an odd multiple, and that a conductive stub (57) of electric length $\lambda/4$ or an odd multiple connects the second contact (59) to the capacitive coupling (56), $\lambda$ being the telecommunication wavelength of the wireless local area network.

7. A telecommunications card according to claim 1, characterised in that the antenna is a single plastic circuit board in polyimide on which the radiation pattern (50) is printed in copper or a copper alloy.

8. A telecommunications card according to claim 1, characterised in that the antenna is integrated into a movable antenna structure (2) which is substantially fully retractable into a cavity (3) within the card.

9. A telecommunications card according to claim 8, characterised in that the antenna structure (2) is removably mounted in the cavity (3).

10. A telecommunications card according to claim 8, characterised in that the antenna is only in electric communication with the electronics when the antenna structure (2) is extended from the cavity (3).

11. A telecommunications card according to claim 8, characterised in that each portion of the radiation pattern (50) is electrically connected to a separate external contact (60, 61) of the movable antenna structure (2), associated contacts being provided on the card for contacting the external contacts (60, 61) of the antenna structure (2), the associated contacts being electrically connected to the electronics within the card.

12. A telecommunications card according to claim 1, characterised in that absorption material is incorporated within the periphery of the telecommunications card (1), the absorption material being chosen such that insertion losses are maximised around the telecommunication frequencies of the antenna.

13. A telecommunications card according to claim 12, characterised in that the absorption material is a thin sheet of silicon rubber blended together with magnetic particles.

14. A telecommunications card according to claim 1, characterized in that the first leg (53) is a thin meander with an electric length of about $\lambda/4$ or an odd multiple for the first frequency band and that the second leg (54) is a wide stub with an electric length of about $\lambda/4$ or an odd multiple for the second frequency band, $\lambda$ being the average wavelength of the respective frequency band, the first and second legs (53, 54) being connected to a common first contact (58) via which the telecommunication signals are conducted to and from said electronics.

15. A telecommunications card for wireless telecommunication between a host device and one or more wireless networks, the card comprising electronics for converting data into telecommunication signals and vice versa and a single antenna structure (2) comprising an antenna in the form of a flat radiation pattern (50) for transmitting and receiving said telecommunication signals, characterized in that said radiation pattern (50) comprises a first portion (51) with a predetermined shape enabling transmission and receipt of telecommunication signals via a mobile telephone network and a second portion (52) with a predetermined shape enabling transmission and receipt of telecommunication signals via wireless local area network, and characterized in that the second portion (52) comprises a radiant element (55) which is capacitively coupled (56) to a second contact (59) via which the telecommunication signals are conducted to and from said electronics.

16. A telecommunications card according to claim 15, characterized in that the first portion (51) comprises a first (53) leg which is shaped for telecommunication in a first mobile telephony frequency band and a second leg (54) which is shaped for telecommunication in a second mobile telephony frequency band different from the first, and characterized in that the first mobile telephony frequency band comprises the frequency of 900 MHz and the second mobile telephony frequency band comprises the frequencies of 1800 MHz and 1900 MHz.

17. A telecommunications card according to claim 16, characterized in that the first leg (53) is a thin meander with an electric length of about λ/4 or an odd multiple for the first frequency band and that the second leg (54) is a wide stub with an electric length of about λ/4 or an odd multiple for the second frequency band, λ being the average wavelength of the respective frequency band, the first and second legs (53, 54) being connected to a common first contact (58) via which the telecommunication signals are conducted to and from said electronics.

18. A telecommunications card according to claim 15, characterized in that the second portion (52) is optimised for telecommunication in a frequency band comprising 2.4 GHz.

19. A telecommunications card according to claim 15, characterized in that the radiant element (55) has a meander configuration of electric length λ/4 or an odd multiple, and that a conductive stub (57) of electric length λ/4 or an odd multiple connects the second contact (59) to the capacitive coupling (56), λ being the telecommunication wavelength of the wireless local area network.

20. A telecommunications card according to claim 15, characterized in that the antenna is a single plastic circuit board in polyimide on which the radiation pattern (50) is printed in copper or a copper alloy.

21. A telecommunications card according to claim 15, characterized in that the antenna is integrated into a movable antenna structure (2) which is substantially fully retractable into a cavity (3) within the card.

22. A telecommunications card according to claim 21, characterized n that the antenna structure (2) is removably mounted in the cavity (3).

23. A telecommunications card according to claim 21, characterized in that the antenna is only in electric communication with the electronics when the antenna structure (2) is extended from the cavity (3).

24. A telecommunications card according to claim 21, characterized in that each portion of the radiation pattern (50) is electrically connected to a separate external contact (60, 61) of the movable antenna structure (2), associated contacts being provided on the card for contacting the external contacts (60, 61) of the antenna structure (2), the associated contacts being electrically connected to the electronics within the card.

25. A telecommunications card according to claim 15, characterized in that absorption material is incorporated within the periphery of the telecommunications card (1), the absorption material being chosen such that insertion losses are maximised around the telecommunication frequencies of the antenna.

26. A telecommunications card according to claim 25, characterized in that the absorption material is a thin sheet of silicon rubber blended together with magnetic particles.

27. A telecommunications card according to claim 15, characterized in that the first portion (51) comprises a first (53) leg which is shaped for telecommunication in a first mobile telephony frequency band and a second leg (54) which is shaped for telecommunication in a second mobile telephony frequency band different from the first, and characterized in that the first leg (53) is a thin meander with an electric length of about λ/4 or an odd multiple for the first frequency band and that the second leg (54) is a wide stub with an electric length of about λ/4 or an odd multiple for the second frequency band, λ being the average wavelength of the respective frequency band, the first and second legs (53, 54) being connected to a common first contact (58) via which the telecommunication signals are conducted to and from said electronics.

28. A telecommunications card for wireless telecommunication between a host device and one or more wireless networks, the card comprising electronics for converting data into telecommunication signals and vice versa and a single antenna structure (2) comprising an antenna in the form of a flat radiation pattern (50) for transmitting and receiving said telecommunication signals, characterised in that said radiation pattern (50) comprises a first portion (51) with a predetermined shape enabling transmission and receipt of telecommunication signals via a mobile telephone network and a second portion (52) with a predetermined shape enabling transmission and receipt of telecommunication signals via a wireless local area network, characterised in that the antenna is integrated into a movable antenna structure (2), and further characterised in that each portion of the radiation pattern (50) is electrically connected to a separate external contact (60, 61) of the movable antenna structure (2), associated contacts being provided on the card for contacting the external contacts (60, 61) of the antenna structure (2), the associated contacts being electrically connected to the electronics within the card.

29. A telecommunications card according to claim 28, characterised in that the first portion (51) comprises a first (53) leg which is shaped for telecommunication in a first mobile telephony frequency band and a second leg (54) which is shaped for telecommunication in a second mobile telephony frequency band different from the first, and characterised in that the first mobile telephony frequency band comprises the frequency of 900 MHz and the second mobile telephony frequency band comprises the frequencies of 1800 MHz and 1900 MHz.

30. A telecommunications card according to claim 29, characterised in that the first leg (53) is a thin meander with an electric length of about λ/4 or an odd multiple for the first frequency band and that the second leg (54) is a wide stub with an electric length of about λ/4 or an odd multiple for the second frequency band, λ being the average wavelength of the respective frequency band, the first and second legs (53, 54) being connected to a common first contact (58) via which the telecommunication signals are conducted to and from said electronics.

31. A telecommunications card according to claim 28, characterised in that the second portion (52) is optimised for telecommunication in a frequency band comprising 2.4 GHz.

32. A telecommunications card according to claim 28, characterised in that the second portion (52) comprises a radiant element (55) which is capacitively coupled (56) to a second contact (59) via which the telecommunication signals are conducted to and from said electronics, and further characterised in that the radiant element (55) has a meander configuration of electric length λ/2 or an odd multiple, and that a conductive stub (57) of electric length λ/4 or an odd multiple connects the second contact (59) to the capacitive coupling (56), λ being the telecommunication wavelength of the wireless local area network.

33. A telecommunications card according to claim 28, characterised in that the first portion (51) comprises a first (53) leg which is shaped for telecommunication in a first mobile telephony frequency band and a second leg (54) which is shaped for telecommunication in a second mobile telephony frequency band different from the first, and characterised in that the first leg (53) is a thin meander with an electric length of about λ/4 or an odd multiple for the first frequency band and that the second leg (54) is a wide stub with an electric length of about λ/4 or an odd multiple for the second frequency band, λ/4 being the average wavelength of the respective frequency band, the first and second legs (53, 54) being connected to a common first contact (58) via which the telecommunication signals are conducted to and from said electronics.

34. A telecommunications card according to claim 28, characterised in that the antenna is a single plastic circuit board in polyimide on which the radiation pattern (50) is printed in copper or copper alloy.

35. A telecommunications card according to claim 28, characterised in that the movable antenna structure (2) is substantially fully retractable into a cavity (3) within the card.

36. A telecommunications card according to claim 35, characterised in that the antenna structure (2) is removably mounted in the cavity (3).

37. A telecommunications card according to claim 35, characterised in that the antenna is only electric communication with the electronics when that antenna structure (2) is extended from the cavity (3).

38. A telecommunications card according to claim 28, characterised in that absorption material is incorporated within the periphery of the telecommunications card (1), the absorption material being chosen such that insertion losses are maximised around the telecommunication frequencies of the antenna.

39. A telecommunications card according to claim 38, characterised in that the absorption material is a thin sheet of silicon rubber blended together with magnetic particles.

* * * * *